US006070276A

United States Patent [19]

Yeung

[11] Patent Number: 6,070,276

[45] Date of Patent: Jun. 6, 2000

[54] TILTING-BOWL TOILET

[76] Inventor: Shu-Ki Yeung, 936, White Street, Saint Laurent, Quebec, Canada, H4M 2W6

[21] Appl. No.: 09/119,358

[22] Filed: Jul. 20, 1998

[30] Foreign Application Priority Data

Aug. 11, 1997 [CA] Canada ..... 2209796

[51] Int. Cl.[7] ..... E03D 11/10

[52] U.S. Cl. ..... 4/442; 4/441

[58] Field of Search ..... 4/442, 420, 440, 4/441, 434

[56] References Cited

U.S. PATENT DOCUMENTS

| | | | |
|---|---|---|---|
| 1,256,320 | 2/1918 | Holmes | 4/442 |
| 2,401,098 | 5/1946 | Peter | 4/442 |
| 3,939,500 | 2/1976 | Miller et al. | 4/442 |
| 4,155,129 | 5/1979 | Russell | 4/442 |

*Primary Examiner*—David J. Walczak

[57] ABSTRACT

To eliminate the necessity of a water tank, this invention converts the traditional toilet bowl with siphonic water trap into a toilet basin with a tilting-bowl. The toilet includes a frame, a toilet basin, a tilting bowl and a trigger means. The tilting bowl is mounted to pivot as a movable water/waste container. In its not tilted horizontal position, the tilting bowl receives and holds water/waste delivered to it through the toilet basin. When the tilting bowl tilts, it discharges its content to drainage pipe through a bottom discharge hole; simultaneously allowing water/waste to discharge from basin to drainage. The tilting bowl is normally retarded to stay in its horizontal position by forces applied to the tilting bowl creating a resultant retarding turning moment about its pivot point larger than the turning moment produced by the tilting bowl with its content. The trigger means serves to remove or reduce the retarding turning moment, allowing the tilting bowl to tilt to discharge water/waste to outside the toilet.

23 Claims, 5 Drawing Sheets

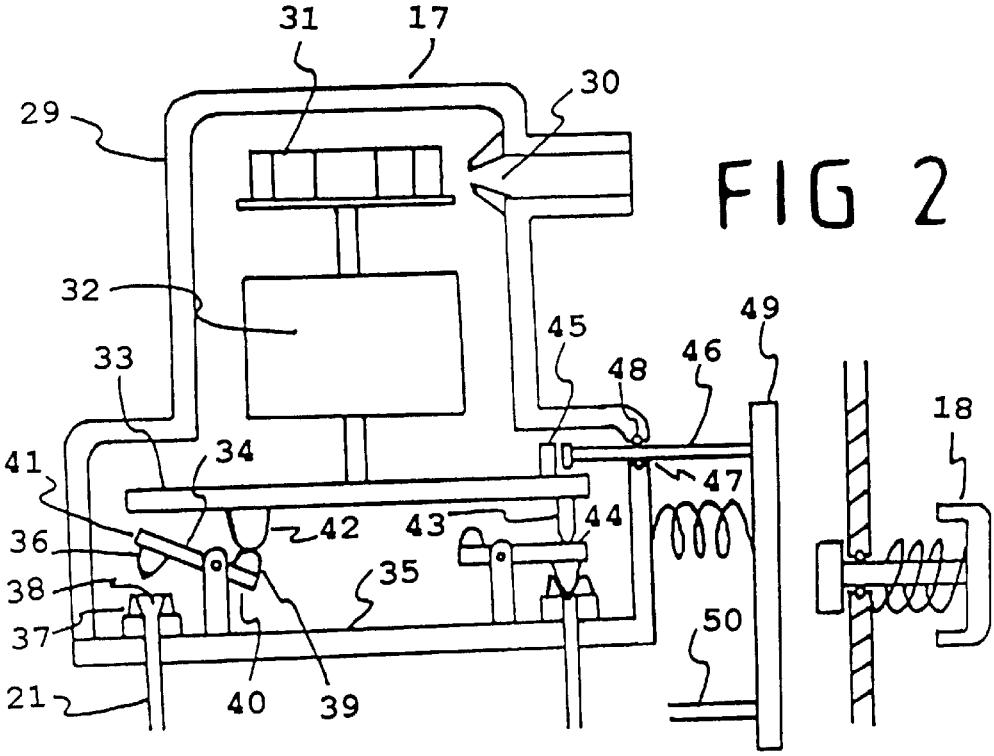
FIG 2
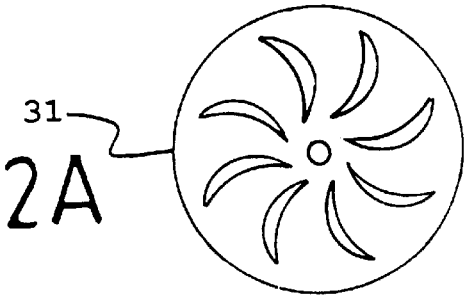
2A
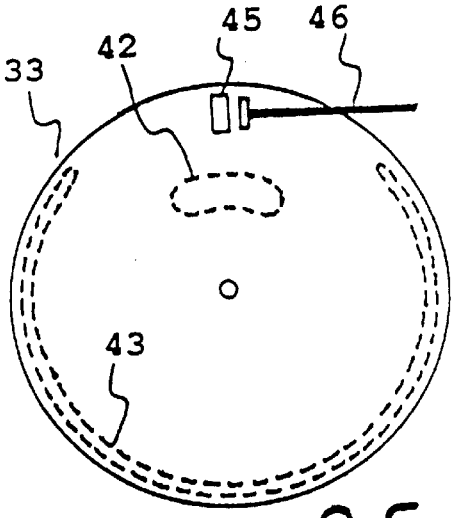
2C
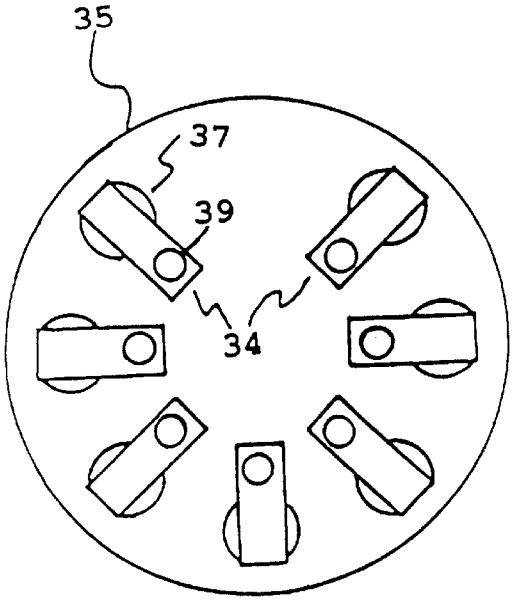
2B

3A

3B

3C

3D

3E

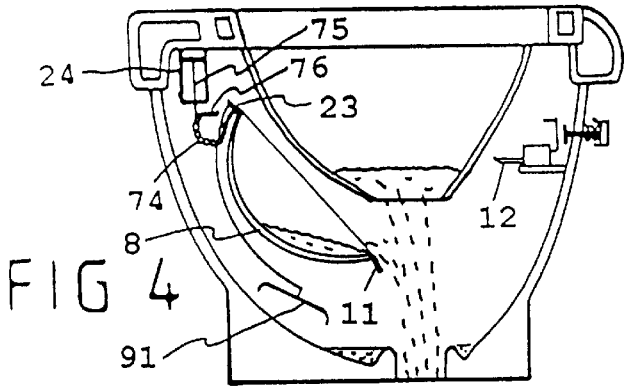
FIG 4
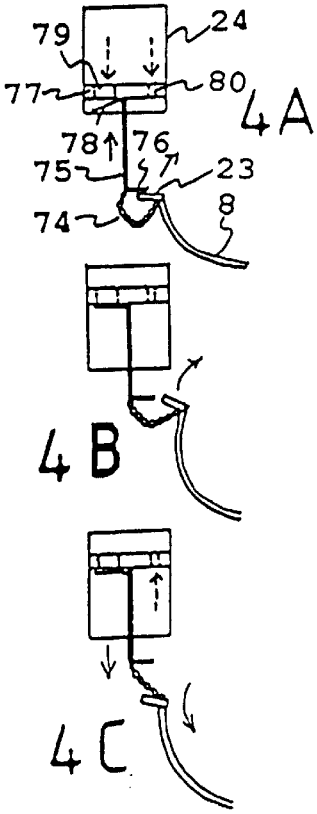
FIG 5
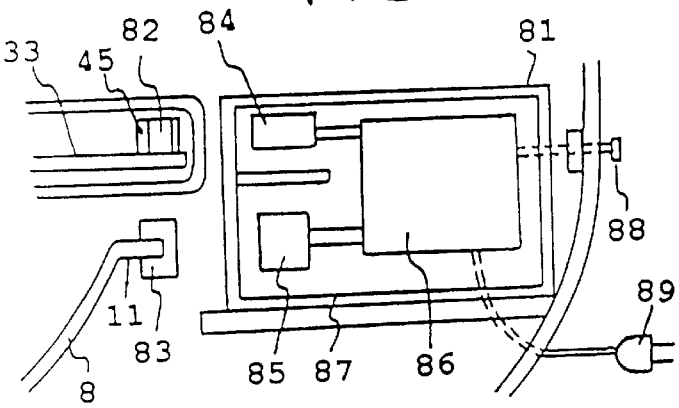
FIG 6
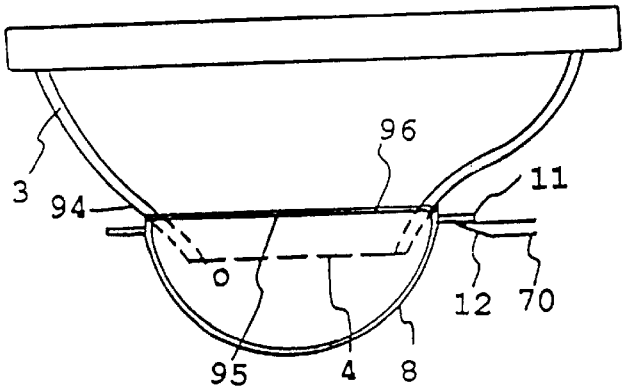

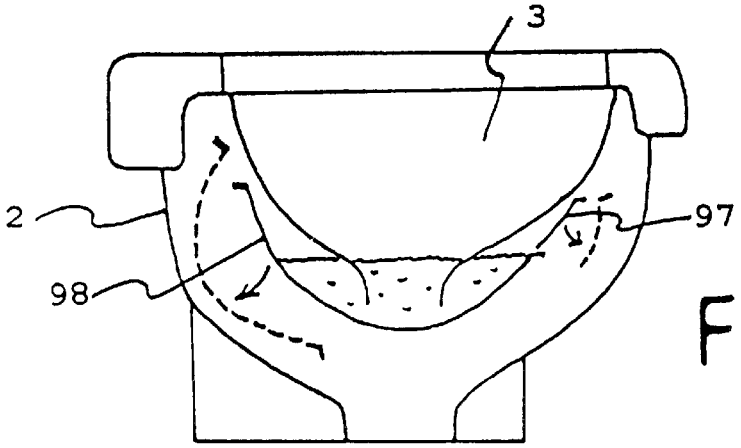
FIG 7
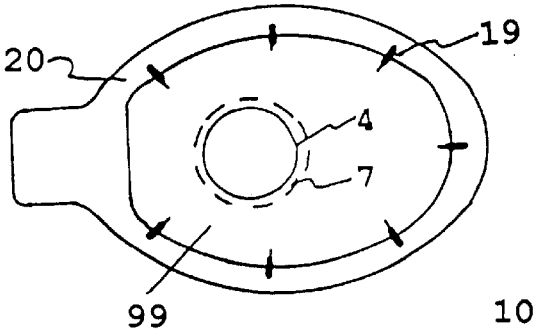
FIG 8
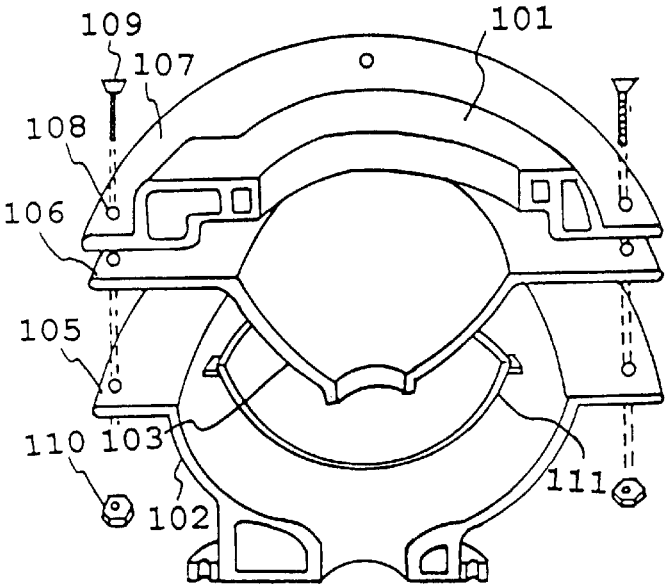
FIG 9
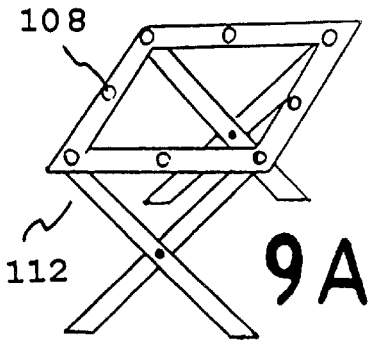
9A
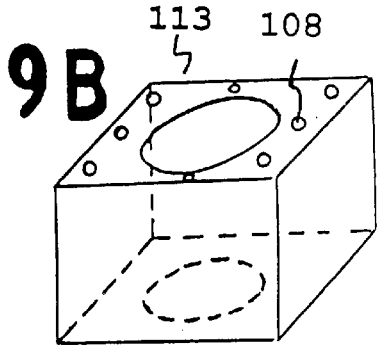
9B

TILTING-BOWL TOILET

BACKGROUND OF THE INVENTION

1. Field of the Invention

The present invention relates to a new tilting-bowl toilet that eliminates siphon and zigzag water trap employed in conventional toilets, thus annihilating most deficiencies associated with traditional toilets. There is no more siphon noise and blocking is reduced to minimum. Further, with optional sequential water ejection, optimum cleaning can be easily obtained even from low water pressure, resulting in significant saving of water, and, traditional water tank is no longer needed.

2. Brief Description of Prior Arts

Major drawbacks of conventional toilets include necessity for a water tank or water pump to create high-pressured water to force water and waste through a zigzag water trap by siphon action, thus consuming big volume of water and making big siphon noise. Low-flow toilets available are often complained about high noise and insufficient cleaning, often necessitating double-flushing.

Other prior arts include those with a small flappable stopper at the discharge hole, hand-driven through complicated mechanism, and are generally only used as vehicle toilets.

Tilting-bowl toilets based on a different working principle, operating in response to addition of water, have also been introduced by the same inventor in U.S. patent application Ser. No. 08/693,084.

SUMMARY OF THE INVENTION

According to a broad aspect of the present invention, there is provided a toilet comprising:

a frame defining a chamber, a toilet basin associated with said frame to define said chamber into an upper chamber region and a lower chamber region, said toilet basin defining at least one basin discharge opening in communication between said upper chamber region and said lower chamber region, a tilting bowl disposed generally in said lower chamber region, said tilting bowl defining a fluid-receiving volume, said tilting bowl mounted for pivoting movement relative to said toilet basin between a substantially horizontal first position to receive and hold fluid communicated through said at least one basin discharge opening, and a second position permitting flow of fluid from said toilet basin, through said at least one basin discharge opening, and from said fluid-receiving volume into said lower chamber region, characterized in that said tilting bowl is retarded to remain in said first position by the resultant of forces applied to said tilting bowl, said resultant of forces producing a retarding turning moment about the effective pivot point at least sufficient to counterbalance the turning moment produced by said tilting bowl with its content, said tilting bowl moves from said first position toward said second position when said retarding turning moment becomes smaller than said turning moment produced by said tilting bowl with its content, means to reduce said retarding turning moment to facilitate said tilting bowl to move from said first position toward said second position.

In accordance with preferred embodiments of the toilet according to the present invention:

said fluid-receiving volume, in said first position, at least partially overlaps said toilet basin, and retains a volume of fluid sufficient to engage said at least one basin discharge opening in a manner to restrict flow of gas therethrough;

said tilting bowl in said first position constitutes an impervious joint with said toilet basin to restrict gas in said lower chamber region from entering said fluid-receiving volume;

the toilet further comprises means to restrict sewage gas from entering said lower chamber region;

said means to restrict sewage gas comprises a liquid seal with a cover;

the toilet further comprises means for delivering water through a plurality of outlets disposed and arrayed to direct water against said toilet basin for cleaning action;

said means for delivering water further comprises sequencing means for delivering water through successive groups of outlet in sequence for improved cleaning action;

said sequencing means comprises rotating means to actuate a plurality of toggle switches to effect delivery of cleaning water to said plurality of outlets in sequence;

the toilet further comprises means for maintaining a predetermined fluid level in said fluid-receiving volume, with said tilting bowl disposed in said first position, said level maintaining means triggering delivery of water when a fluid level below said predetermined fluid level is detected and stops delivery of water when a fluid level at least equal to said predetermined fluid level is detected;

the toilet further comprises means defined by said tilting bowl to discharge excessive fluid when fluid level in said fluid-receiving volume exceeds a prescribed level;

delivery of water to said plurality of outlets and movement of said tilting bowl from said first position toward said second position are actuated simultaneously after toilet is triggered to operate;

delivery of water to said plurality of outlets and movement of said tilting bowl from said first position toward said second position are actuated at different time intervals after toilet is triggered to operate;

the toilet further comprises a combined trigger means for actuating delivery of cleaning water and facilitating said tilting bowl to move from said first position toward said second position;

the toilet further comprises means to disable triggering when said tilting bowl and/or water delivery is operating;

said means to disable triggering is controlled by fluid level in said fluid-receiving volume;

the toilet is adapted for manual triggering, and/or electronic triggering, and/or remote triggering, and/or automatic triggering in response to departure of user;

said forces applied to said tilting bowl comprise constituents of gravity force and/or magnetic force and/or pneumatic force and/or hydraulic force and/or spring force and/or electrical force and/or electromagnetic force;

said tilting bowl, is biased to return from said second position toward said first position;

the toilet further comprises retard means to retard said tilting bowl from returning from said second position toward said first position;

said retard means comprises a piston;

said at least one basin discharge opening is disposed generally above a bottom discharge hole and with a vertical projection view at least partially overlapping a vertical projection view of said bottom discharge hole;

said plurality of outlets are arrayed to define an enclosure region disposed generally above said at least one basin discharge opening, said enclosure region casting a vertical projection view at least partially overlapping a vertical projection view of said at least one basin discharge opening;

said plurality of outlets are arrayed to define an enclosure region generally above a bottom discharge hole, said enclosure region casting a vertical projection view at least partially overlapping a vertical projection view of said bottom discharge hole;

said tilting bowl comprises a one-piece bowl mounted to pivot about a substantially horizontal axis;

said tilting bowl comprises multiple bowl pieces, at least one bowl piece mounted to pivot about a substantially horizontal axis;

the toilet is supplied in separate parts and comprises separate and/or foldable frame, separate and/or foldable toilet basin, separate and/or foldable tilting bowl, separate and/or foldable water storage container, and/or separate and/or foldable waste container;

the toilet comprising separate and/or foldable parts is packed in a portable package.

The objects, advantages and unique features of present invention will be illustrated and explained by the following non-restrictive description of preferred embodiments thereof, given by way of example only with reference to the accompanying drawings.

BRIEF DESCRIPTION OF THE DRAWING

In the appended drawings:

FIG. 2 is a cross-sectional view a preferred sequential valve to supply cleaning water to the toilet; FIG. 2A is a top view of the turbine inside valve; FIG. 2B is top view of valve base with toggle switches; FIG. 2C is top view of program disc;

FIGS. 3A, 3B, 3C, 3D & 3E shown in sequence operation of the trigger mechanism;

FIG. 4 is a cross-sectional view of a preferred embodiment of the toilet showing the tilting bowl in tilted position. FIGS. 4A, 4B & 4C illustrates in sequence how retard means for bowl return operates;

FIG. 5 shows a preferred embodiment with an electronic trigger unit;

FIG. 6 shows, in cross-sectional view, a preferred embodiment with a dry gas seal;

FIG. 7 is a cross-sectional view of a preferred embodiment with complimentary tilting bowl pieces;

FIG. 8 is a top view of a preferred embodiment of the toilet showing preferred locations of array of jet outlets, basin discharge opening and bottom discharge hole.

FIG. 9 is a cross-sectional perspective view of a preferred self-installable embodiment with separate and/or foldable parts.

FIG. 9A shows a preferred foldable frame and FIG. 9B shows a preferred enclosure.

DETAILED DESCRIPTION OF THE PREFERRED EMBODIMENTS

Figure 1:
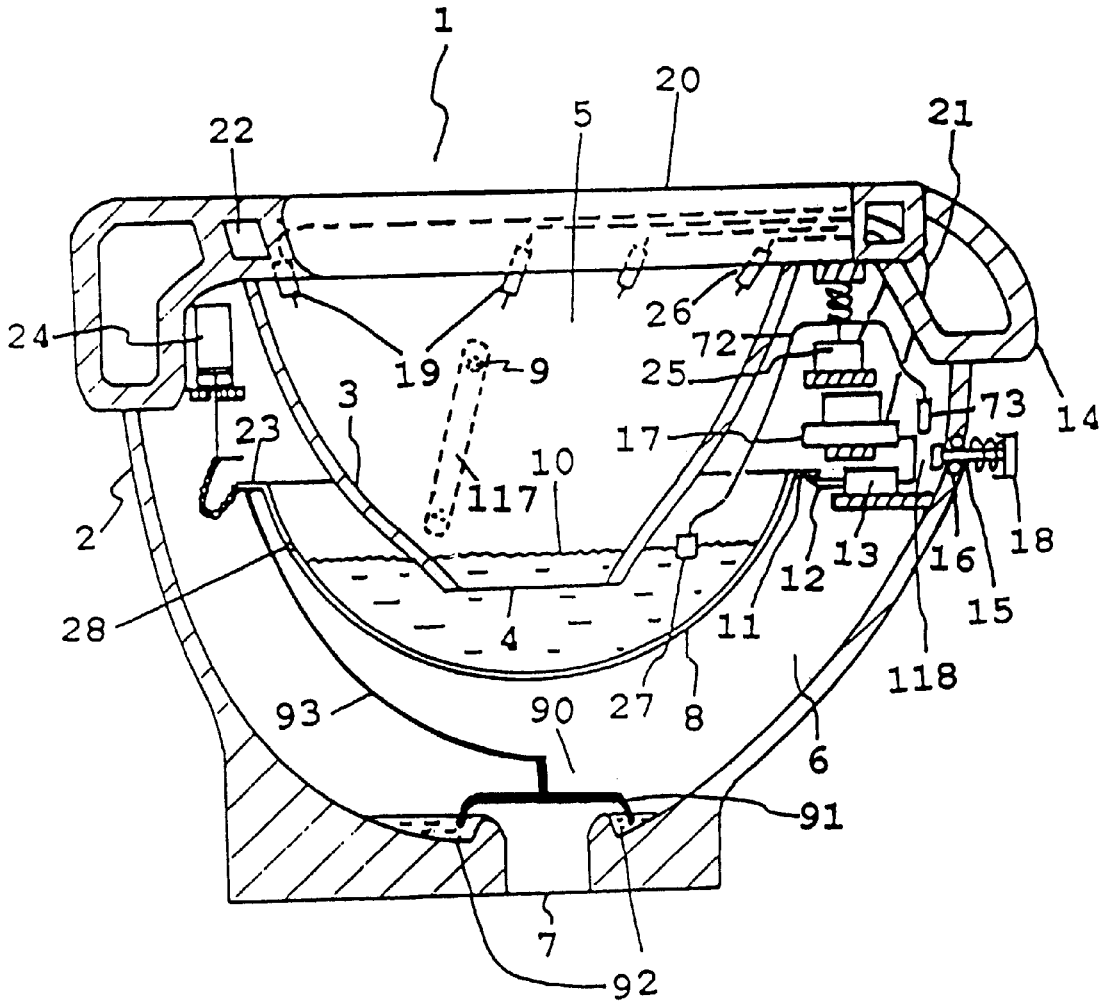
FIG. 1 is a cross-sectional view of a preferred embodiment of the toilet in accordance with the present invention, comprising a tilting bowl.

A preferred embodiment of the toilet in accordance with the present invention is illustrated in FIG. 1, and is generally identified by the reference 1.

Toilet 1 comprises a frame 2 which supports a toilet basin 3 with a basin discharge opening 4 such that basin 3 partitions frame 2 into an upper chamber region 5 and a lower chamber region 6, with discharge opening 4 forming a communication channel between them. Lower chamber region 6 comprises a bottom discharge hole 7 for discharging waste and water to sewage pipes outside the toilet (not shown).

A tilting bowl 8 is mounted inside lower chamber region 6, with mounting support 117, to pivot about a substantially horizontal axis 9, relative to basin 3 between a basically horizontal first position, with tilting bowl 8 encompassing a lower part of toilet basin 3, to receive and hold water communicated through basin discharge opening 4, and a tilted second position to discharge waste water through bottom discharge hole 7. Normally, tilting bowl 8, in its first position, retains a standby charge of water to maintain a water level 10 to engulf basin discharge opening 4, thus forming a gas seal to restrict gas from passing therethrough.

Tilting bowl 8 is sustained to stay in its first position by a small tongue 11, at a rim of tilting bowl 8, resting on tip 12 of support plank 70, which forms part of a trigger assembly 13. Trigger assembly 13 is preferably located inside frame 2 near basin front flange 14 to facilitate convenient triggering. A water supply valve 17 is preferably fixed adjacent to trigger assembly 13, so that cleaning water and bowl tilting can be simultaneously triggered with a single push of trigger switch 18 which goes through side opening 15 on frame 2. Dynamic O-ring 16 is fitted inside side opening 15 to assure imperviousness. Triggering will be described in detail later.

Jet outlets 19 are preferably located along toilet basin rim 20, and orientated to eject water to effectively clean toilet basin 3. Cleaning water is supplied by valve 17 to jet outlets 19 through pipes 21. Basin rim 20 is preferably made hollow inside so that a hollow channel 22 will conveniently house and distribute the water pipes 21.

To operate the toilet, the user need only press trigger switch 18. Trigger switch 18 as shown here is a simple push-button, but any mechanism serving the purpose, e.g. a lever handle, a rotational device etc. may be used.

FIG. 2 shows the basic design of valve 17, which, as illustrated in this preferred embodiment, is a sequential valve so that jet outlets 19 will eject at pre-programmed sequence with strong water pressure to optimize best cleaning effect. However, for areas where water supply pressure is strong, non-sequential valve may also be used.

Cylindrical valve casing 29 is watertight. Supply water is directed through a special water input passage 30, inside casing 29, to effectively drive a turbine 31. A top view of turbine 31 is shown in FIG. 2A. Turbine 31 in turn drives a set of speed-reducing gears 32, whose gear ratio is chosen to match desired cycle time to clean the toilet. Speed-reducing gears 32 in turn drives a program-disc 33. Beneath program-disc 33 is a circular array of toggle switches 34, pivoted to toggle as on/off switches for supplying water to pipes 21 which in turn deliver cleaning water to jet outlets 19.

FIG. 2B is top view of the valve base 35 with on/off toggle switches 34 arrayed in a ring pattern. Each toggle switch has a rubber cone stopper 36 at the lower surface of its outer arm 41. Inlet stud 37 of water pipe 21 is exactly under rubber cone 36, and recess cavity 38 at the exact entrance of inlet stud 37 is molded to match the outer curvature of cone stopper 36 to form a well-fit to stop water from flowing in when toggle switch 34 is in flat "off" position. Small spherical projection 39 is molded on the upper surface of toggle switch 34's inner arm 40. Inner arm 40 is significantly shorter than outer arm 41. A larger turning moment is therefore produced by outer arm 41, and toggle switch 34 thus normally rests in flat "off" position with rubber cone 36 fitted into recess cavity 38. Water pressure pressing on outer arm 41 also assists in stopping water from going into inlet stud 37.

FIG. 2C is a top view of program-disc 33. The under side of program-disc 33 is fitted with circular actuator ribs 42 and guard ribs 43. For simple illustration, only one of each is shown. Actuator rib 42 is so positioned and of such a height that when program-disc 33 rotates, it will pass on spherical projection 39 to force toggle switch 34 to toggle to "on" position and lift up outer arm 41 so that rubber cone stopper 36 retreats from recess cavity 38, allowing water to enter inlet stud 37 of pipe 21 to finally eject through jet outlet 19. For smooth operation, actuator ribs 42 are with ends tapered. Guard ribs 43, also on the under side of program-disc 33 are so positioned and of such a height that it just touches the upper surface 44 of the outer arm 41 of toggle switch 34 to assure no water enters inlet stud 37. Of course, guard ribs 43 are positioned only at rotation angles that demand toggles switches 34 to be "off" whilst actuator ribs 42 are positioned at rotation angles that demand toggle switches 34 to be "on".

A small starter board 45 is located on the upper side of program-disc 33, close to its rim. At standby, starter board 45 is perpendicularly facing a plunger 46, which goes through a side hole 47 of the valve casing 29, with a dynamic O-ring 48 to assure imperviousness. Plunger 46 rests out of the travelling locus of starter board 45, hence would not interfere with rotation of program-disc 33. For smooth operation, it is desirable to have valve 17 always fully filled with water, including at standby.

In this preferred embodiment, a single push on trigger switch 18 will simultaneously trigger both sequential valve 17 and trigger assembly 13. This is achieved by means of a twin plunger 49 with plunger arm 50 to activate trigger assembly 13 and plunger arm 46 to start sequential valve 17. Referring to FIG. 2, when trigger switch 18 is pushed, plunger arm 46 will in turn push starter board 45 to rotate to a predetermined angle that actuator ribs 42 will turn on at least one of the toggle switches 34. Once water flows through a water pipe 21, incoming water through water passage 30 drives turbine 31 to rotate, thus starting the valve cycle. Actuator ribs 42 are so positioned that once valve cycle is started, at least one toggle switch 34 will remain pressed "on" at any time during the cycle, and therefore program-disc 33 will be driven to keep rotating. As program-disc 33 rotates, actuator ribs 42 will travel on the toggle switches in pre-determined sequence, and hence water pipes 21 will be sequentially supplied with water. Toggle switches 34 are so arrayed that there is a gap with no toggle switch, corresponding to the standby angle, so that after actuator ribs 42 pass through the last toggle switch, water stops flowing. Thus the valve cycle stops with the program-disc 33 resting on its standby angle.

By locating toggle switches 34 at different radii from center of rotation with corresponding actuator ribs 42 at specific rib lengths, it is basically possible to program any desired ejection sequence to optimize cleaning effect. To assure smooth operation of valve 17, it may be desirable to add a filter to water input passage 30, so that residue can be screened off to a sink for disposal (not shown).

Whilst trigger switch 18 returns immediately upon release, return of plunger 46 is synchronized with tilting bowl operation, so that after tilting bowl 8 returns to its first position, water still runs to maintain a desirable volume of standby water, to be discussed later.

Figure 3:
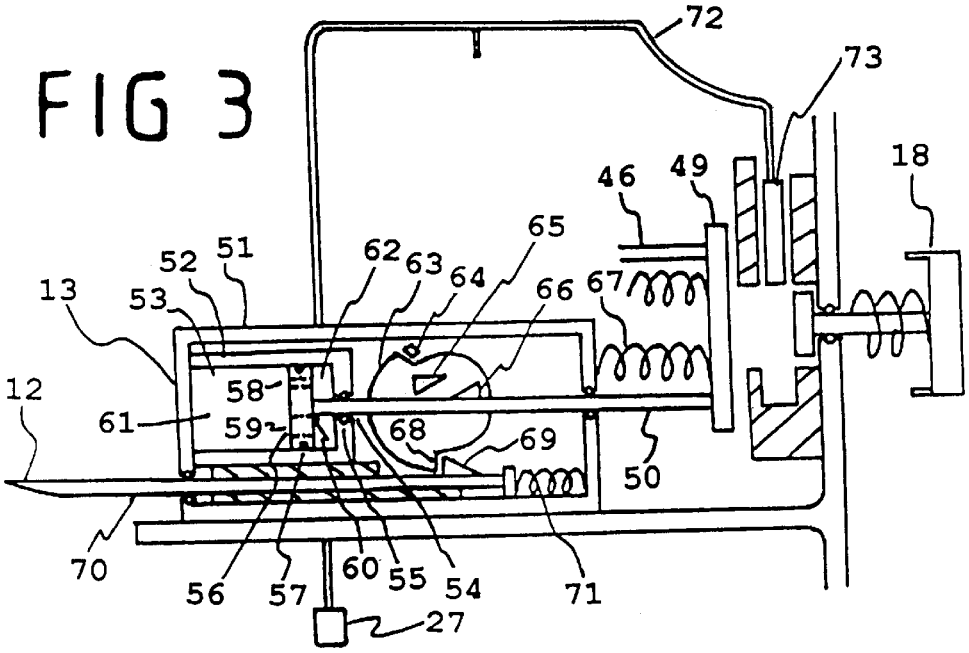
FIG. 3 is a cross-sectional view of a preferred triggering assembly for bowl tilting.
Figure 3:
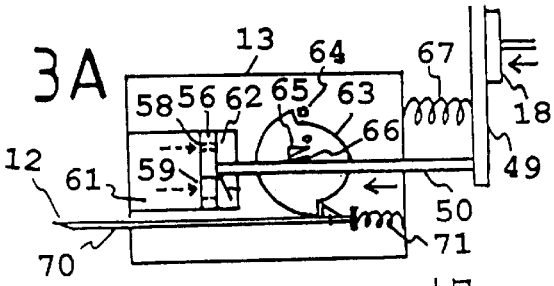
Figure 3:
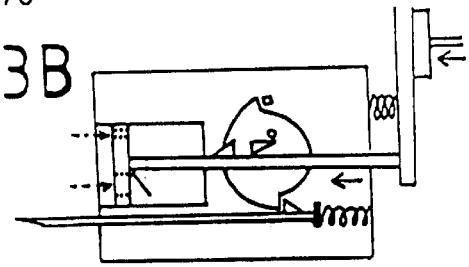
Figure 3:
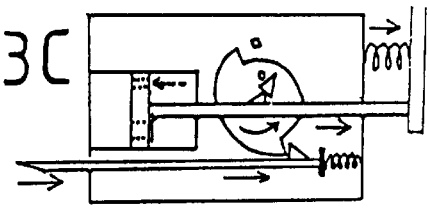
Figure 3:
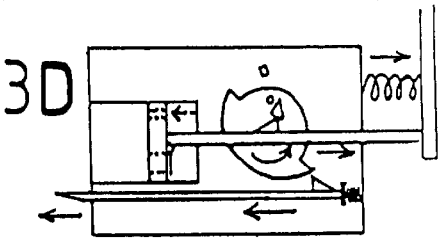
Figure 3:
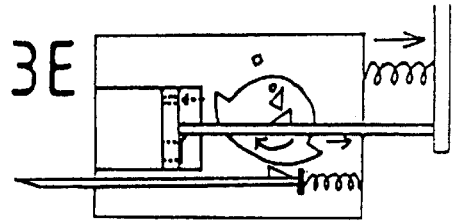

Whilst any suitable trigger mechanism may be used, FIG. 3 shows a cross-sectional view of trigger assembly 13 employed in present preferred embodiment of toilet 1.

Inside casing 51 of trigger assembly 13 is a return retard means 52 in form of a cylindrical air chamber 53 with a small circular opening 54 and a dynamic O-ring 55 to assure imperviousness. Plunger arm 50 of twin plunger 49 goes into casing 51 and directly passes into air chamber 53 through opening 54. A circular piston 56 is fixed to the end of plunger arm 50. To assure imperviousness, a dynamic O-ring 57 may be added along the circumference rim of piston 56. Piston 56 comprises 2 holes, hole 58 is smaller in diameter whilst hole 59 is larger in diameter. A flapper lid 60 is hinged to the plunger side of hole 59. Flapper lid 60 is of larger diameter than hole 59 so that when it covers hole 59, it can stop air passing through, and when it opens, it let air pass easily. Thus piston 56 divides air chamber 53 into compartments 61 and 62.

A cam 63 is located adjacent to plunger arm 50 as shown, and is stopped from turning clockwise at standby by a stopper 64. On surface of cam 63 is a protruding stud 65 which will come into contact with a flexible barb 66 on plunger arm 50 when trigger switch 18 is pressed.

Operation of trigger assembly 13 can be best illustrated by FIGS. 3A. 3B, 3C, 3D and 3E, in sequence.

When trigger switch 18 is pressed, twin plunger 49 is in turn pressed. While plunger arm 46 activates sequential valve 17, plunger arm 50 pushes piston 56 to go deeper into air chamber 53. Air inside compartment 61 is thus forced to escape into compartment 62, through both hole 58 and hole 59, as flapper lid 60 is forced open by air passing through. Also, flexible barb 66 is gradually pressed down as it reaches protruding stud 65, as shown in FIG. 3A.

As protruding stud 65 is taper in shape, plunger arm 50 travels with little resistance while flexible barb 66 is gradually pressed down by the forthcoming protruding stud 65. After passing over protruding stud 65, flexible barb 66 resumes its tilted up status as plunger arm 50 travels further into air chamber 53, as shown in FIG. 3B.

Upon release, trigger switch 18 returns to its standby position. Twin plunger 49 is also biased to return by one or more springs 67. However, as plunger arm 50 returns, air is forced to travel from compartment 62 to compartment 61, in a direction that presses flipper lid 60 to close larger diameter hole 59, forcing air to pass slowly through only smaller hole 58. Thus plunger arm 50 is retarded to return slowly. When tilted-up end of barb 66 eventually comes into contact with flat end of protruding stud 65, cam 63 is pressed to start turning in anti-clockwise direction. As cam 63 turns, cam tooth 68 pushes a barb 69 on support plank 70, which is desirably metallic, forcing support plank 70 to retreat as shown by arrows on FIG. 3C.

Support plank 70 protrudes outside assembly casing 51 as shown, with tip 12 supporting tongue 11 of tilting bowl 8 as previously described. As support plank 70 retreats, tip 12 eventually gets out of contact with bowl tongue 11. Without support, tilting bowl 8 starts to tilt to discharge its content. As cam 63 continues turning, cam tooth 68 gradually goes upwards until it passes over flexible barb 69. Once barb 69 is released from cam tooth 68, support plank 70, biased by a smaller plank spring 71, starts going back to its standby location, as shown in FIG. 3D.

As cam 63 continues turning anti-clockwise, protruding stud 65 gradually moves upwards until it finally gets out of contact with flexible b arb 66. As soon as barb 66 is out of its way, cam 63 starts to return clockwise to its standby position, either by a spring attached to stopper 64 (not shown), or simply pivoted to return, as shown in FIG. 3E. As cam 63 returns, cam tooth 68 presses down barb 69 which is also flexible. When cam 63 reaches its standby position, barb 69 is released and resumes its shoot-up posture to engage with cam tooth 68 again as at start. Plunger arm 50 and hence twin plunger 49 continues its slow return until standby locations are reached.

The purpose of retarding return of plunger arm 50 is to delay bowl tilting by a desirable time period after triggering cleaning water to allow thorough cleaning of dirt on toilet basin prior to discharging. Desirable delay period can be achieved by adjusting diameter of hole 58.

Referring again to FIG. 1, to restrict sewage gas from entering lower chamber region 6, a liquid seal 90 is formed with a circular groove 92 encircling bottom discharge hole 7 and a circular cover 91 with diameter matching that of circular groove 92. The rim of circular cover 91 totally dips into water retained in groove 92, thus forming a complete liquid seal to restrict gas from passing through. Cover 91 is connected to bowl ledge 23 with a connector 93. Hence when tilting bowl 8 tilts, cover 91 is simultaneously lifted up to render bottom discharge hole 7 open. It is of course possible to use dry seals for seal 90, e.g. rubber seals, without deviating from scope of this invention.

FIG. 4 shows tilting bowl 8 in tilted second position with cover 91 lifted up, allowing waste and water, from toilet basin 3 and from tilting bowl 8, to be discharged through bottom discharge hole 7. After discharging its content, tilting bowl 8 is biased to return, simply by turning moment created by a properly weighed cover 91. Alternatively, bias may be provided by a spring connecting bowl ledge 23 to frame 2, or by other types of retarding forces, e.g. a hydraulic press or a pneumatically driven piston applied to ledge 23. For optimum cleaning of toilet basin 3, it is desirable to retard tilting bowl 8 to return slowly. Hence, a short chain 74 links ledge 23 to plunger shaft 75 of a retard means 24, which is similar in structure to previously described retard means 52, fixed to an upper area inside chamber 6 as shown. FIGS. 4A, 4B, & 4C explain how tilting bowl 8 is retarded from returning.

In FIG. 4A, as tilting bowl 8 starts to tilt, bowl ledge 23 rises and begins to contact bend 76, pushing plunger shaft 75 upwards. Piston 77 goes up swiftly with air passing through both larger hole 79 and smaller hole 80, as flipper lid 78 is opened by air passing through.

As tilting bowl 8 tilts, bowl ledge 23 moves upward on a circular locus. Thus bowl ledge 23 eventually goes out of contact with shaft bend 76 when piston 77 is pushed to a predetermined maximum height, as shown in FIG. 4B.

Returning tilting bowl 8, after pulling straight short chain 74, is retarded as piston 77 can only travel slowly. With larger hole 79 closed by flipper lid 78, air can pass only through smaller hole 80, as shown in FIG. 4C.

Since tip 12 of support plank 70 has a flat upper surface and a curved lower surface, returning bowl tongue 11 pushes tip 12, and hence support plank 70, to retreat. After tongue 11 passes above tip 12, support plank 70 returns and tip 12 resumes its standby position to support tongue 11. This works same way as the shuttle of a door lock when the door is closed. Simultaneously, circular cover 91 also returns to its standby position to cover bottom discharge hole 7 forming a liquid seal.

Water ejection stops when sequential valve 17 finishes its operation cycle. Cycle time is predetermined, by proper choice of gear ratio for speed-reducing gears 32 and program-disc 33, to desirably retain a volume of clean water in tilting bowl 8 to maintain water level 10 at standby. In case water level 10 has not been reached when valve 17 stops, individual valve 25, controlled by float 27 will keep supplying water through an individual outlet 26 until water level 10 is reached. On the other hand, if water level is too high, excessive water will be discharged through side opening 28 on tilting bowl 8, as in FIG. 1.

It would be desirable not to allow trigger switch 18 to be triggered during toilet operation. To achieve this, a blocking metal plate 73 is included into float mechanism 72 linked with float 27 so that the water level control system also serves to disable triggering when water level in tilting bowl 8 is below level 10. Referring again to FIG. 1, when water level falls below level 10, float 27 falls, float mechanism 72 also falls, bringing down metal plate 73 to block passage 118 through which trigger switch 18 would pass, making triggering impossible. After tilting bowl 8 has resumed its first position and as water level increases, float 27 rises and metal plate 73 goes up simultaneously. When water level 10 is reached, blocking metal plate 73 will be out of passage 118 where triggering switch 18 travels, and triggering becomes possible again. Thus, triggering is prohibited during toilet operation.

It need be reiterated that whilst return retard means are employed in this preferred embodiment for optimal cleaning effect, this invention can be with or without any of these return retard means. In case pre-washing is not needed, with simple modification of the trigger mechanism, bowl tilting can be triggered simultaneously with watering. Similarly, it is also possible for bowl tilting to discharge its content prior to delivery of cleaning water. Alternatively, with an independent trigger switch, bowl tilting can be triggered without water supply. Also, by deleting return retard means 24, tilting bowl 8 can return immediately after discharging its content.

Whilst so far it is described that tilting bowl 8 is supported to stay in first position by support plank 70, magnetic force may also be employed, by simply fixing a piece of ferrous metallic plate to tongue 11 and a magnet of suitable strength to tip of support plank 70, with a gap of suitable width between plate and magnet. When plank 70 retreats, magnetic attraction force is reduced as gap width increases, thus allowing tilting bowl 8 to tilt. This has the advantage that there is no contact between tongue 11 and plank 70, thus minimizing tear and wear.

FIG. 5 shows an embodiment with an electronic trigger unit 81. A piece of permanent magnet 82 is embedded inside starter board 45 and a ferrous metal block 83 is fixed to tongue 11. At standby, magnet 82 and block 83 are facing solenoid coils 84 and 85 respectively as shown. Solenoid coils 84 and 85, properly shielded to prevent interference, are connected to electronic control board 86, all inside housing 87. Control board 86 is connected to trigger switch 88 and to a power cord 89 for electricity supply.

At standby, solenoid coil 85 is energized as an electromagnet to attract block 83, with sufficient holding force to keep tilting bowl 8 in first position, whilst no electricity is supplied to solenoid coil 84. When trigger switch 88 is pressed, a signal is sent to control board 86, which in turn delivers a pulse to energize solenoid coil 84, generating a magnetic force in opposite polarity to permanent magnet 82, thus propelling magnet 82, and hence program-disc 33, to rotate to start the watering cycle. Timing unit inside control board 86 will delay, for a predetermined interval of time, a pulse to shut off solenoid coil 85. When solenoid coil 85 is shut off, magnetic holding force disappears and tilting bowl 8 starts to tilt toward second position. As triggering is by pulse, both solenoid coils soon resume standby status. As usual, tilting bowl 8 is biased to return. Thus, toilet operation is electronically triggered with better efficiency.

More sophisticated embodiments are possible by adding a sensor to electronic trigger unit 86. Thus when a sensor sensing the presence of a user is added, control unit can be programmed to automatically trigger operation upon departure of user. Alternatively, when radio-wave sensor, sound sensor or infra-red sensor is added, operation of the toilet can be remotely triggered. Of course, various means of triggering, including electronic, remote, automatic means, may be incorporated into the same embodiment for convenience of user. A manual trigger may also be included to safeguard breakdown of sophisticated triggering means.

For those skilled in the art, plunger arms 46 and 50, and/or support plank 70, may be easily designed to be jointly or separately controlled by electrical motor, or pneumatically or hydraulically driven. Tilting bowl 8 may also be retarded to stay in its horizontal first position by different kinds of forces, including but not limited to, gravity force, electrical force, electromagnetic force, magnetic force, pneumatic force, hydraulic force, and/or spring force, in any suitable combination, applied to bowl tongue 11, flat ledge 23 and/or other areas of tilting bowl 8, by modification at will to the preferred embodiments.

In cases preferred, e.g. for economical embodiments without level control, a dry gas seal can be incorporated between tilting bowl and toilet basin to prevent sewage gas from escaping through basin discharge opening 4, as shown in FIG. 6. In this embodiment, toilet basin 3 is shaped to match curvature of rim 95 of tilting bowl 8. As before, tilting bowl 8 is mounted to pivot about a substantially horizontal axis and biased to return, when empty, from its tilted second position toward its not-tilted first position to be engaged with support plank 70. In this first position, rim 95 totally matches the under surface 94 of basin 3 to form an impervious joint, thus restricting any gas in lower chamber region 6 from entering tilting bowl 8. For better sealing effect, a rubber lining 96 can also be added along rim 95 as shown.

FIG. 7 shows a preferred embodiment with complementary tilting bowl pieces 98 and 97. Larger bowl piece 98 has a minimum height, at its lowest rim, higher than predetermined water level 10, thus assuring no gas leakage problem. Normally only larger bowl piece 98 tilts, as controlled by trigger assembly 13, whilst smaller bowl piece 97 can be made stationary. However, by simple modifications to trigger assembly 13 or by adding a complementary to support plank 70, both complementary tilting bowl pieces 98 and 97 can be triggered to tilt simultaneously. The advantage of this embodiment is that the total height of toilet 1 can be reduced as less upward movement space is needed when bowl piece 98 tilts. In case dry seal is desired, rubber linings can be added to rims of both bowl pieces.

Since the zigzag water trap in traditional toilets have been eliminated, it is possible for this invention to locate basin discharge opening 4 directly above bottom discharge hole 7 and connect bottom discharge hole 7 directly to sewage pipes which are normally just a short distance from a wall. Thus, when tilting bowl 8 tilts to discharge, waste water can be directly poured into sewage outlets, resulting in minimum blocking chance, and requires minimum water to carry away waste. In fact, in this invention, region 99 encircled by array of jet outlets 19, the basin discharge opening 4, and the bottom discharge hole 7 may be made concentric, as in FIG. 8, or preferably, with vertical views of projection overlapping one another. In cases preferred, basin discharge opening 4 may consist of m ore than one opening to facilitate easier discharge of waste.

FIG. 9 shows another preferred embodiment comprising separate parts of individual frame, tilting bowl, basin and toilet rim for user assembly. Frame 102, basin 103 and toilet rim 101 each comprises matching flanges 105, 106 and 107 respectively, with matching screw holes 108 suitably located as shown. A user can then assemble the toilet by fixing the separate parts together with screws 109 and nuts 110. The advantage of this embodiment is that separate toilet parts, including fixing accessories, can be packed into a compact package, making the toilet portable.

By making the separate parts foldable, the package volume can be further minimized. Thus, when made with flexible materials like nylon or thick PVC, tilting bowl 111 can be designed to be foldable. Frame 102 can also be replaced by a foldable skeleton support 112, like that used in foldable chairs, with matching screw holes 108, and a matching PVC envelope 113, also with matching screw holes 108, as shown in FIGS. 9A & 9B. With these foldable parts, all toilet components, including mounting and fixing accessories can be packed inside a container the size of an attache case. For use as portable toilets, where tap water may not be available, it is desirable that foldable water storage container be also included. Of course, for easy disposal of waste, foldable waste containers, e.g. in form of PVC bags can also be included.

Whilst features of present invention are described with reference to preferred embodiments, it is herewith reiterated that these embodiments can be modified at will, within scope of the appended claims, without departing from spirit and nature of subject invention.

What are claimed are:

1. A toilet comprising:

a frame defining a chamber, a toilet basin associated with said frame to define said chamber into an upper chamber region and a lower chamber region, said toilet basin defining at least one basin discharge opening in communication between said upper chamber region and said lower chamber region, a tilting bowl disposed generally in said lower chamber region, said tilting bowl defining a fluid-receiving volume, said tilting bowl mounted for pivoting movement relative to said toilet basin between a substantially horizontal first position to receive and hold fluid communicated through said at least one basin discharge opening, and a second position permitting flow of fluid from said toilet basin, through said at least one basin discharge opening, and from said fluid-receiving volume into said lower chamber region, and actuating means to start toilet operation, characterized in that said tilting bowl is retarded to remain in said first position by the resultant of forces applied to said tilting bowl, said resultant of forces producing a retarding turning moment about a pivot axis at least sufficient to counterbalance the turning moment produced by said tilting bowl with its content, said tilting bowl moves from said first position toward said second position when said retarding turning moment becomes smaller than said turning moment produced by said tilting bowl with its content, and said actuating means actuates to release at least part of said retarding turning moment to allow said tilting bowl to move from said first position toward said second position.

2. The toilet of claim 1, wherein said fluid-receiving volume, in said first position, at least partially overlaps said toilet basin, and retains a volume of fluid sufficient to engage said at least one basin discharge opening in a manner to restrict flow of gas therethrough.

3. The toilet of claim 1, wherein said tilting bowl in said first position constitutes an impervious joint with said toilet basin to restrict gas in said lower chamber region from entering said fluid-receiving volume.

4. The toilet of claim 1, further comprising means to restrict sewage gas from entering said lower chamber region.

5. The toilet of claim 4, wherein said means to restrict sewage gas comprises a liquid seal with a cover.

6. The toilet of claim 1, further comprising means for delivering water through a plurality of outlets disposed and arrayed to direct water against said toilet basin for cleaning action.

7. The toilet of claim 6, wherein said means for delivering water further comprises sequencing means for delivering water through successive groups of outlet in sequence for improved cleaning action.

8. The toilet of claim 7, wherein that said sequencing means further comprises rotating means to actuate a plurality of toggle switches to effect delivery of cleaning water to said plurality of outlets in sequence.

9. The toilet of claim 6 further comprising means for maintaining a predetermined fluid level in said fluid-receiving volume, with said tilting bowl disposed in said first position, said level maintaining means triggering delivery of water when a fluid level below said predetermined fluid level is detected and stops delivery of water when a fluid level at least equal to said predetermined fluid level is detected.

10. The toilet of claim 6, wherein delivery of water to said plurality of outlets and movement of said tilting bowl from said first position toward said second position start simultaneously.

11. The toilet of claim 6, wherein delivery of water to said plurality of outlets and movement of said tilting bowl from said first position toward said second position start at different time intervals.

12. The toilet of claim 6, wherein said actuating means further actuates delivery of cleaning water.

13. The toilet of claim 6, wherein said plurality of outlets are arrayed to define an enclosure region disposed generally above said at least one basin discharge opening and said bottom discharge hole, said enclosure region casting a vertical projection view at least partially overlapping a vertical projection view of said at least one basin discharge opening and/or at least overlapping a vertical projection view of said bottom discharge hole.

14. The toilet of claim 1 further comprising means defined by said tilting bowl to discharge excessive fluid when fluid level in said fluid-receiving volume exceeds a prescribed level.

15. The toilet of claim 1 further comprising means to disable actuation when said toilet is operating.

16. The toilet of claim 13, wherein said means to disable actuation is controlled by fluid level in said fluid-receiving volume.

17. The toilet of claim 1, wherein said toilet is adapted for manual actuation, and/or electronic actuation, and/or remote actuation, and/or automatic actuation in response to departure of user.

18. The toilet of claim 1, wherein said forces applied to said tilting bowl comprise constituents of gravity force and/or magnetic force and/or pneumatic force and/or hydraulic force and/or spring force and/or electrical force and/or electromagnetic force.

19. The toilet of claim 1, wherein said tilting bowl is biased to return from said second position toward said first position.

20. The toilet of claim 19 further comprising retard means to retard said tilting bowl from returning from said second position toward said first position.

21. The toilet of claim 1, wherein said at least one basin discharge opening is disposed generally above a bottom discharge hole and with a vertical projection view at least partially overlapping a vertical projection view of said bottom discharge hole.

22. The toilet of claim 1, wherein said tilting bowl comprises multiple bowl pieces, at least one bowl piece mounted to pivot about a substantially horizontal axis.

23. The toilet of claim 1 comprising separate and/or foldable frame, separate and/or foldable toilet basin, separate and/or foldable tilting bowl, separate and/or foldable water storage container, and/or separate and/or foldable waste container.

* * * * *

UNITED STATES PATENT AND TRADEMARK OFFICE

CERTIFICATE OF CORRECTION

PATENT NO : 6,070,276

DATED : 06/06/2000

INVENTOR(S) : YEUNG Shu-Ki

It is certified that error appears in the above-identified patent and that said Letters Patent are hereby corrected as shown below:

Claim 16 should be dependent to Claim 15 (not 13)

Signed and Sealed this

Third Day of April, 2001

*Attest:*

Nicholas P. Godici

NICHOLAS P. GODICI

*Attesting Officer*

*Acting Director of the United States Patent and Trademark Office*